United States Patent [19]

Holden

[11] 4,012,530

[45] Mar. 15, 1977

[54] PRODUCE TRAY

[75] Inventor: Morell J. Holden, Canandaigua, N.Y.

[73] Assignee: Mobil Oil Corporation, New York, N.Y.

[22] Filed: July 7, 1975

[21] Appl. No.: 593,615

[52] U.S. Cl. ..... 426/124; 206/45.33; 206/564; 217/26.5; 229/25 R; 229/29 M; 426/106

[51] Int. Cl.[2] ..... B65D 85/34; B65D 65/16; B65D 1/36

[58] Field of Search ..... 229/2.5 R, 2.5 EC, 29 M; 217/26.5, 27; 426/119, 124, 129, 396, 106; 206/526, 72, 45.33

[56] References Cited

UNITED STATES PATENTS

| | | | |
|---|---|---|---|
| 1,987,525 | 1/1935 | Chaplin | 217/27 |
| 3,128,030 | 4/1964 | Davies | 229/2.5 |
| 3,212,907 | 10/1965 | Caprioli | 426/119 |
| 3,217,962 | 11/1965 | Weiss | 229/2.5 |
| 3,424,363 | 1/1969 | Donovan | 229/29 M |
| 3,568,830 | 3/1971 | Moren | 229/29 M |
| 3,591,032 | 7/1971 | Baxter | 217/26.5 |
| 3,651,930 | 3/1972 | Artz | 229/2.5 |
| 3,695,453 | 10/1972 | Martelli | 217/26.5 |
| 3,708,084 | 1/1973 | Bixler et al. | 217/26.5 |
| 3,829,056 | 8/1974 | Baker et al. | 229/29 M |
| 3,902,622 | 9/1975 | Emery | 217/26.5 |

*Primary Examiner*—Stephen P. Garbe
*Assistant Examiner*—Bruce H. Bernstein
*Attorney, Agent, or Firm*—Charles A. Huggett; Hastings S. Trigg

[57] ABSTRACT

There is provided a thermoplastic produce tray characterized by having a series of spaced apart, concave ribs or saddles extending upward from the bottom into the side walls. The ribs are adapted to cradle substantially globular produce.

5 Claims, 6 Drawing Figures

FIG. 6
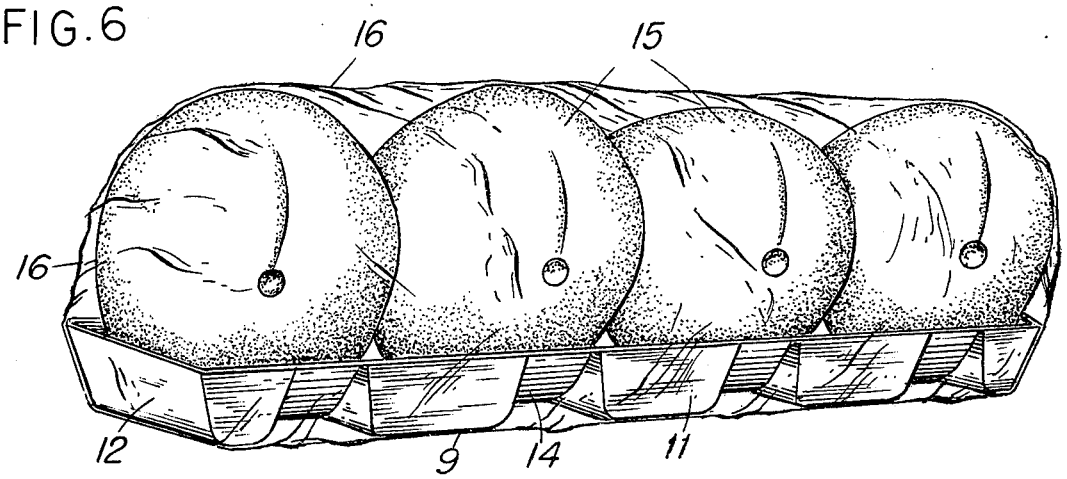
FIG. 1
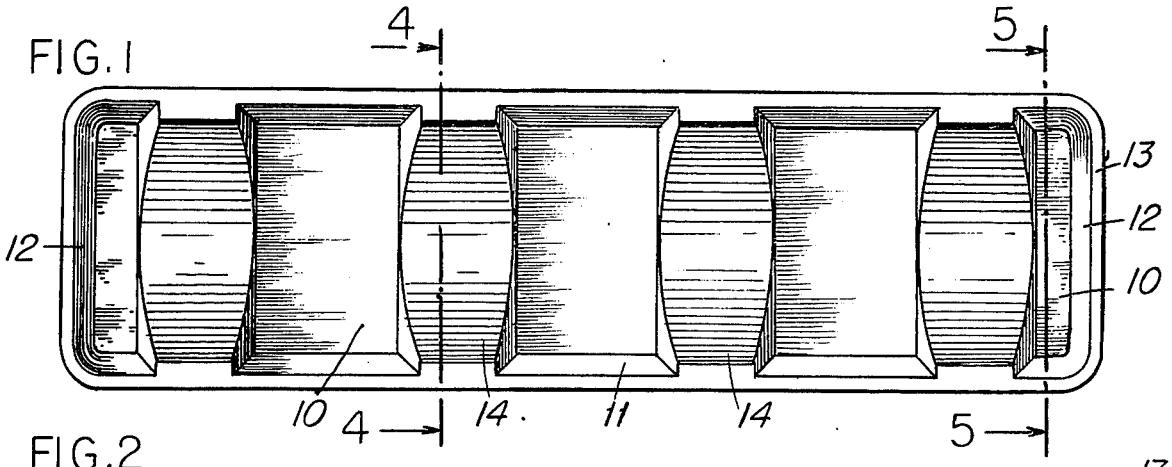
FIG. 2
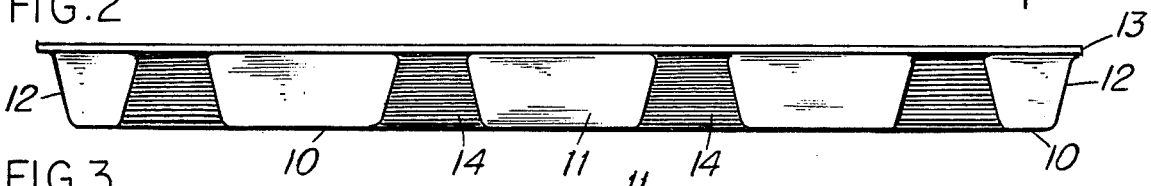
FIG. 3
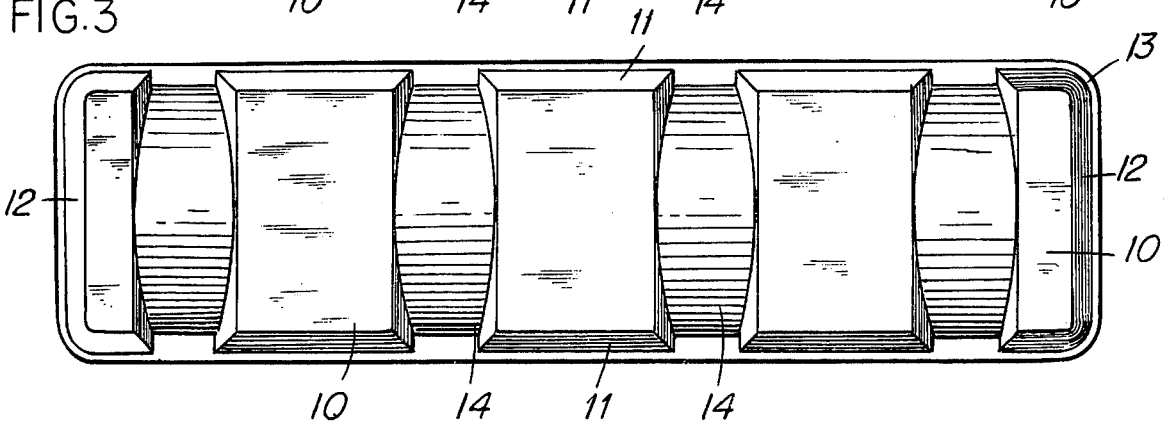
FIG. 4
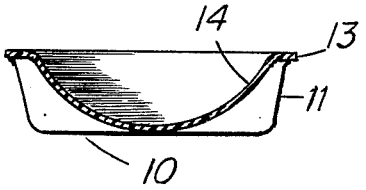
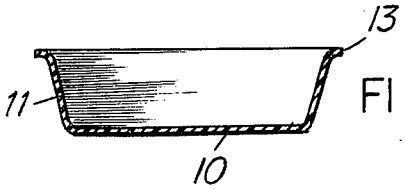
FIG. 5

PRODUCE TRAY

BACKGROUND OF THE INVENTION

1. Field of the Invention

This invention relates to thermoplastic trays that are particularly adapted to cradle substantially globular produce.

2. Description of the Prior Art

It has become commonplace in the retail marketing of produce to package the produce in individual consumer size packages. Such packages generally comprise a shallow rectangular flat suppport tray in which the produce is retained in the tray by an overwrap of transparent material such as, for example, polyvinylchloride, cellophane, or polyethylene film and the like.

In the case of substantially globular produce, however, prior art trays have not provided sufficient support to such produce to prevent bruising in the package. In a flat tray, globular produce, such as peaches or apples, have a single tangential point of contact which localizes the pressure on the produce and provides a basis for bruising. The advantage of ribs or saddles in the structure of this invention is to spread the weight of the produce over a relatively large area, thus reducing local pressure below the point of bruising. Insofar as is now known the packaging tray of this invention, which cradles substantially globular produce, has not been proposed.

SUMMARY OF THE INVENTION

This invention provides a produce tray comprising a bottom member joined integrally around its periphery to continuous upstanding side walls and end walls and a plurality of spaced apart concave ribs extending upwardly from said bottom member into said side walls.

DESCRIPTION OF THE DRAWINGS

FIG. 1 is a top plan view of a tray of this invention.

FIG. 2 is a side elevational view of the tray shown in FIG. 1.

FIG. 3 is a bottom view of the tray shown in FIG. 1.

FIG. 4 is a cross-sectional view of a rib portion of the tray taken along the reference line 4—4 of FIG. 1.

FIG. 5 is a cross-sectional view of a non-ribbed portion of the tray taken along the reference line 5—5 of FIG. 1.

FIG. 6 is a perspective view of a produce package comprising the tray shown in FIG. 1, substantially globular produce, and a transparent overwrap.

DESCRIPTION OF SPECIFIC EMBODIMENTS

As is illustrated in the drawings, the produce tray 9 of this invention comprises a bottom member or wall 10 joined integrally around its periphery to upstanding side walls 11 and end walls 12. The side walls 11 and the end walls 12 are continuous. The end walls can be substantially straight as shown in FIGS. 1 and 3, but preferably they can be semi-circular. Optionally and for added strength, the side walls and end walls can be provided with a lip 13 extending outward about the upper periphery, but such lip is not a necessary or essential feature of the tray of this invention.

The produce tray of this invention is provided with a plurality of concave ribs 14 extending upwardly from the bottom member 10 into the side walls 11, thus forming a saddle-like member. The concave profile of the ribs is more apparent in the cross-sectional view of FIG. 4 and in the perspective view of FIG. 6. It will be noted that the concave profile defines an arc of a circle. The ribs 14 are substantially uniformly spaced apart, so that each rib will cradle a produce article without interfering with a produce article cradled on an adjacent rib. These ribs can have a substantially uniform width or they can be tapered (tumble home), as is shown in FIGS. 1, 2, and 3.

It will be apparent to those skilled in the art that the specific width and spacing of the individual adjacent ribs may vary within wide limits. In general, the width of each rib can vary between about 0.5 inch and about 1.5 inches. The spacing between adjacent ribs can vary between about one inch and about 2 inches. In preferred practice, the sum of the width of each rib and the space between it and its adjacent rib will be roughly equivalent to the average diameter of the substantially globular produce to be packaged in the tray.

Generally, produce such as peaches and apples are graded by size, i.e., by diameter. For a given diameter produce, the diameter of the circle of which the rib or saddle defines an arc will be slightly smaller (about ⅛inch) than the diameter of the produce. For example, in a tray dimensioned to pack produce of 2⅝ inches size the diameter of the circle forming the rib would be about 2¼ inches. This slightly smaller dimension will cause the fruit to deflect the tray side wall slightly. This provides contact and support for the produce for the full length of the rib. Such support will distribute the weight of the produce over a much greater area than a flat tray, thereby avoiding localized pressure which will break down the fiber of the produce and lead to bruising and production degradation.

As has been indicated hereinbefore, the tray of this invention is adapted, in particular, to packaging of substantially globular produce. By "substantially globular produce" is meant fruits and vegetables that are substantially, but not perfectly, spherical such as, by way of non-limiting examples, apples, peaches, plums, pomegranates, tomatoes, rutabaga and artichokes. It will be appreciated, of course, that the tray of this invention can be used to package perfectly spherical articles such as golf balls.

The primary application for the tray of this invention is by the grower or central packer, rather than at the supermarket. Several sized trays would be provided, each with a saddle "diameter" and spacing between the ribs or saddles to accomodate the specific variety and size of the produce to be packaged. The value of the cradling or cushioning effect of the ribs or saddles is best realized when the product is packaged at a considerable distance from the ultimate consumer market. Thus, produce (e.g., peaches, apples, pears, or tomatoes) could be packaged at the major growing areas and shipped to the major consumer areas in the United States or abroad.

In FIG. 6, there is shown a packaged product in accordance with this invention. It comprises a tray 9, as described hereinbefore, a plurality of items of substantially globular produce 15 (peaches shown) cradled in each of the concave ribs 14, and a transparent overwrap 16.

The tray structures of this invention can be formed from a variety of materials including pulp, but it is more preferably formed from plastic material. Thermoplastic or thermosetting resin polymers may be employed, however, thermoplastic materials are preferred. Suitable thermoplastic resins include vinyl aromatic polymers such as polystyrene, polyolefins, such as polyethylene, polypropylene, polybutene, etc; polyvinylchloride; polyvinylidene chloride; rubber hydrohalides; polyesters and copolymers and mixtures of such resins.

Standard forming techniques such as, for example, vacuum or pressure forming may be employed to form the trays from preformed plastic sheet. Alternatively, the trays may be formed directly from uniform resinous materials utilizing for example injection molding or rotational molding techniques. A preferred material for construction of the trays of this invention has been found to be foamed polystyrene sheet or oriented clear polystyrene sheet. The thickness of the tray structure may vary within wide limits, principally dependent upon the end use intended for such trays. However, for purposes of the present invention foamed polystyrene sheet thicknesses on the order from about 50 mils to about 200 mils, and preferably from about 80 mils to about 130 mils, have been found to be satisfactory.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A tray packaging substantially globular produce comprising a single, continuous substantially planar bottom member joined integrally around its periphery to a continuous upstanding pair of side walls and pair of end walls; said bottom member being interrupted by a plurality of uniformly spaced concave ribs extending upwardly from said bottom member into said side walls and extending from side wall to side wall, thus forming saddle-like members whose concave profile defines an arc of a circle and each of which cradle substantially globular produce; said saddle-like members being aligned in a single row with planar sections of said bottom separating said saddle-like members; the width of each saddle-like member being between about 0.5 inch and about 1.5 inches and the space between adjacent saddle-like members being between about 1 inch and about 2 inches, said width being sufficient to cradle and support one article of produce when said produce is positioned on adjacent members.

2. A tray as described in claim 1, wherein the diameter of the circle of which the saddle-like member defines an arc, is about ⅛ inch smaller than the diameter of the substantially globular produce to be packaged in said tray.

3. A tray as described in claim 1, wherein said tray is a thermoplastic tray.

4. A tray as described in claim 3, wherein said thermoplastic is foamed polystyrene.

5. A packaged product that comprises a tray as defined in claim 1, a plurality of items of substantially globular produce cradled in each of said ribs, and a transparent overwrap.

* * * * *